US010605036B2

(12) United States Patent
Shampine

(10) Patent No.: US 10,605,036 B2
(45) Date of Patent: Mar. 31, 2020

(54) DEPLOYMENT BLOW OUT PREVENTER WITH INTERLOCK

(71) Applicant: SCHLUMBERGER TECHNOLOGY CORPORATION, Sugar Land, TX (US)

(72) Inventor: Rod William Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/550,592

(22) PCT Filed: Feb. 10, 2016

(86) PCT No.: PCT/US2016/017256
§ 371 (c)(1),
(2) Date: Aug. 11, 2017

(87) PCT Pub. No.: WO2016/130620
PCT Pub. Date: Aug. 18, 2016

(65) Prior Publication Data

US 2018/0030802 A1 Feb. 1, 2018

Related U.S. Application Data

(60) Provisional application No. 62/115,731, filed on Feb. 13, 2015.

(51) Int. Cl.
*E21B 33/06* (2006.01)
*E21B 34/16* (2006.01)
*E21B 33/064* (2006.01)

(52) U.S. Cl.
CPC ..... *E21B 33/062* (2013.01); *E21B 34/16* (2013.01); *E21B 33/064* (2013.01)

(58) Field of Classification Search
CPC ..... E21B 33/062
(Continued)

(56) References Cited

U.S. PATENT DOCUMENTS 4,325,434 A 4/1982 Roberts
4,940,095 A 7/1990 Newman
(Continued)

FOREIGN PATENT DOCUMENTS

WO 2001020129 A2 3/2001
WO 2010064920 A1 6/2010
(Continued)

OTHER PUBLICATIONS

International Search Report and Written Opinion issued in International Patent Appl. No. PCT/US2016/017259 dated Apr. 25, 2016; 25 pages.
(Continued)

*Primary Examiner* — Taras P Bemko
(74) *Attorney, Agent, or Firm* — Cathy Hewitt

(57) ABSTRACT

Methods include providing a blowout preventer body having at least one sealing ram for engaging with a downhole tool, and the sealing ram is hydraulically actuatable between a ram open position and a ram closed position. A hydraulic control valve is provided and used for sensing a differential pressure across the at least one sealing ram. The hydraulic control valve is fluidly connected to the blowout preventer body, and the hydraulic control valve operates as a hydraulic interlock to prevent the at least one sealing ram from being moved to the ram open position under predetermined differential pressure conditions. The blowout pre-venter is connected to a wellhead disposed on a wellbore, and the downhole tool and coiled tubing are deployed into and out of the wellbore.

22 Claims, 4 Drawing Sheets

(58) Field of Classification Search
USPC ..... 166/250.01
See application file for complete search history.

(56) References Cited

U.S. PATENT DOCUMENTS

| | | | | |
|---|---|---|---|---|
| 6,050,338 | A | 4/2000 | Watkins | |
| 6,164,619 | A | 12/2000 | Van Winkle et al. | |
| 6,192,983 | B1 | 2/2001 | Neuroth et al. | |
| 6,209,652 | B1 | 4/2001 | Portman et al. | |
| 6,913,084 | B2 | 7/2005 | Boyd | |
| 7,814,972 | B2 | 10/2010 | Angman et al. | |
| 8,047,295 | B2 | 11/2011 | Skeels et al. | |
| 8,146,660 | B2 | 4/2012 | Irani et al. | |
| 9,080,412 | B2 | 7/2015 | Wetzel et al. | |
| 2004/0104024 | A1 | 6/2004 | Kent et al. | |
| 2007/0051512 | A1 | 3/2007 | Markel et al. | |
| 2007/0137866 | A1 | 6/2007 | Ravensbergen et al. | |
| 2007/0162235 | A1 | 7/2007 | Zhan et al. | |
| 2009/0084558 | A1 | 4/2009 | Bloom | |
| 2009/0260804 | A1 | 10/2009 | Mydur et al. | |
| 2010/0104372 | A1 | 4/2010 | Lawson et al. | |
| 2010/0155054 | A1 | 6/2010 | Innes et al. | |
| 2010/0163243 | A1 | 7/2010 | Sbordone | |
| 2010/0230112 | A1 | 9/2010 | Cox et al. | |
| 2011/0267922 | A1* | 11/2011 | Shampine ..... | E21B 47/0005 367/25 |
| 2011/0272148 | A1 | 11/2011 | Lovell et al. | |
| 2012/0125622 | A1 | 5/2012 | Melancon et al. | |
| 2013/0341539 | A1 | 12/2013 | Hughes et al. | |
| 2014/0048256 | A1 | 2/2014 | Ringgenberg | |
| 2014/0166270 | A1 | 6/2014 | Varkey et al. | |
| 2014/0231075 | A1 | 8/2014 | Springett et al. | |
| 2016/0215584 | A1 | 7/2016 | Tennant | |

FOREIGN PATENT DOCUMENTS

| | | | |
|---|---|---|---|
| WO | 2014074099 | A1 | 5/2014 |
| WO | 2016130612 | A1 | 8/2016 |
| WO | 2016130617 | A1 | 8/2016 |
| WO | 2016130619 | A1 | 8/2016 |
| WO | 2016130620 | A1 | 8/2016 |

OTHER PUBLICATIONS

International Search Report and Written Opinion issued in International Patent Appl. No. PCT/US2016/017254 dated May 3, 2016; 14 pages.

International Search Report and Written Opinion issued in International Patent Appl. No. PCT/US2016/017250 dated May 11, 2016; 10 pages.

International Search Report and Written Opinion issued in International Patent Appl. No. PCT/US2016/017243 dated May 17, 2016; 11 pages.

International Search Report and Written Opinion issued in International Patent Application No. PCT/US2016/017256 dated May 3, 2016; 17 pages.

* cited by examiner

DEPLOYMENT BLOW OUT PREVENTER WITH INTERLOCK

RELATED APPLICATION INFORMATION

This Patent Document claims priority under 35 U.S.C. § 120 to U.S. Provisional Patent Application No. 62/115,731 filed Feb. 13, 2015, the entire disclosure of which is incorporated by reference herein in its entirety.

FIELD

The present disclosure is related in general to wellsite equipment such as oilfield surface equipment, downhole assemblies, coiled tubing (CT) assemblies, slickline and assemblies, and the like.

BACKGROUND

Coiled tubing is a technology that has been expanding its range of application since its introduction to the oil industry in the 1960's. Its ability to pass through completion tubulars and the wide array of tools and technologies that can be used in conjunction with it make it a very versatile technology.

Typical coiled tubing apparatus includes surface pumping facilities, a coiled tubing string mounted on a reel, a method to convey the coiled tubing into and out of the wellbore, such as an injector head or the like, and surface control apparatus at the wellhead. Coiled tubing has been utilized for performing subterranean formation operations, well treatment operations, and/or well intervention operations in existing wellbores such as, but not limited to, hydraulic fracturing, matrix acidizing, milling, perforating, coiled tubing drilling, and the like.

In coiled tubing operations, the process whereby downhole tools are transferred from atmospheric pressure to wellbore pressure is referred to as coiled tubing deployment. Coiled tubing deployment is typically accomplished using a riser long enough that the entire downhole tool may be placed inside the riser at once, and then pressurizing the riser after placing the tool therein. However, for longer tools this is not feasible due to limitations on the maximum height for a coiled tubing injector (depending on charge pressure and crane availability). In such an instance, the downhole tools are lowered into the well in sections and hung off of the blowout preventer (BOP) rams using a deployment bar that matches the coiled tubing diameter. These deployment bar sections are placed in a riser and may be conveyed in by coiled tubing, wireline, or slickline.

It remains desirable to provide improvements in oilfield surface equipment and/or downhole assemblies such as, but not limited to, methods and/or systems for deploying coiled tubing into wellbores whereby the deployment of coiled tubing may be improved by providing interlocks to prevent opening of the blowout preventer when high pressure is sensed below the blowout preventer.

SUMMARY

This section provides a general summary of the disclosure, and is not a necessarily a comprehensive disclosure of its full scope or all of its features.

In a first aspect of the disclosure, methods include providing a blowout preventer body having at least one sealing ram for engaging with a downhole tool, and the sealing ram is hydraulically actuatable between a ram open position and a ram closed position. A hydraulic control valve is provided and used for sensing a differential pressure across the at least one sealing ram. The hydraulic control valve is fluidly connected to a cavity defined by the blowout preventer body, and the hydraulic control valve operates as a hydraulic interlock to prevent the at least one sealing ram from being moved to the ram open position under predetermined differential pressure conditions. The blowout preventer is connected to a wellhead disposed on a wellbore, and the downhole tool and coiled tubing are deployed into and out of the wellbore. The at least one sealing ram may be a pipe ram, or a pipe/slip ram. In some cases, the hydraulic control valve includes a poppet and control piston arrangement adjacently disposed within the hydraulic control valve.

In some embodiments, the at least one sealing ram is contained within a cylinder formed in the blowout preventer body, and each of the at least one sealing rams is connect with a ram piston sealingly disposed in the cylinder. The ram piston and the cylinder may define a first and a second fluid chamber, with the first fluid chamber in fluid communication with a poppet in the hydraulic control valve, and the second fluid chamber in fluid communication with a control piston in the hydraulic control valve. The hydraulic control valve may further be in fluid communication with a selector valve, and the selector valve provides open, neutral and closed positions for regulating hydraulic fluid flow. In some embodiments, the hydraulic control valve operates as a hydraulic interlock when pressure on the subterranean formation side of the blowout preventer body is higher than pressure on the top side of the blowout preventer, and in some cases, the hydraulic control valve operates as a hydraulic interlock when pressure in a second fluid chamber is higher than pressure in a first fluid chamber.

In another aspect of the disclosure, methods of deploying coiled tubing into and out of a wellbore include providing a blowout preventer body having at least one sealing ram for engaging with a downhole tool, where the at least one sealing ram is contained within a cylinder formed in the blowout preventer body, and connected with a ram piston sealingly disposed in the cylinder. A hydraulic control valve is further provided which includes a poppet and control piston arrangement adjacently disposed therein, and fluidly connected with the blowout preventer body. The blowout preventer is connected to a wellhead disposed on a wellbore, and the downhole tool and coiled tubing are deployed into and out of the wellbore. In some embodiments, the ram piston and the cylinder define a first and a second fluid chamber, and the first fluid chamber is in fluid communication with the poppet while the second fluid chamber is in fluid communication with the control piston. The hydraulic control valve may operate as a hydraulic interlock when pressure second fluid chamber is higher than pressure the first fluid chamber.

Yet another aspect provides systems including a blowout preventer body having at least one sealing ram for engaging with a downhole tool, where the sealing ram is hydraulically actuatable between a ram open position and a ram closed position, and the system further includes a hydraulic control valve including a poppet and control piston arrangement positioned adjacently. The hydraulic control valve is fluidly connected with a cavity defined by the blowout preventer body, and the blowout preventer is sealingly connected with a wellhead disposed on a wellbore. A downhole tool and coiled tubing may be deployed through the blowout preventer body, the wellhead and the wellbore, as part of the overall system. The ram piston and the cylinder may define a first and a second fluid chamber, where the first fluid chamber is in fluid communication with the poppet and the second fluid chamber in fluid communication with the control piston, and the hydraulic control valve may operate as a hydraulic interlock when pressure second fluid chamber is higher than pressure the first fluid chamber.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

The following description of the variations is merely illustrative in nature and is in no way intended to limit the scope of the disclosure, its application, or uses. The description and examples are presented herein solely for the purpose of illustrating the various embodiments and should not be construed as a limitation to the scope and applicability of such. Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present). In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated. The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited. Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Embodiments of the present disclosure include a blowout preventer (BOP) provided with an additional hydraulic valve that senses the differential pressure across a sealing ram and, when it senses a higher pressure on the bottom than the top, it prevents the ram from being opened.

Figure 1:
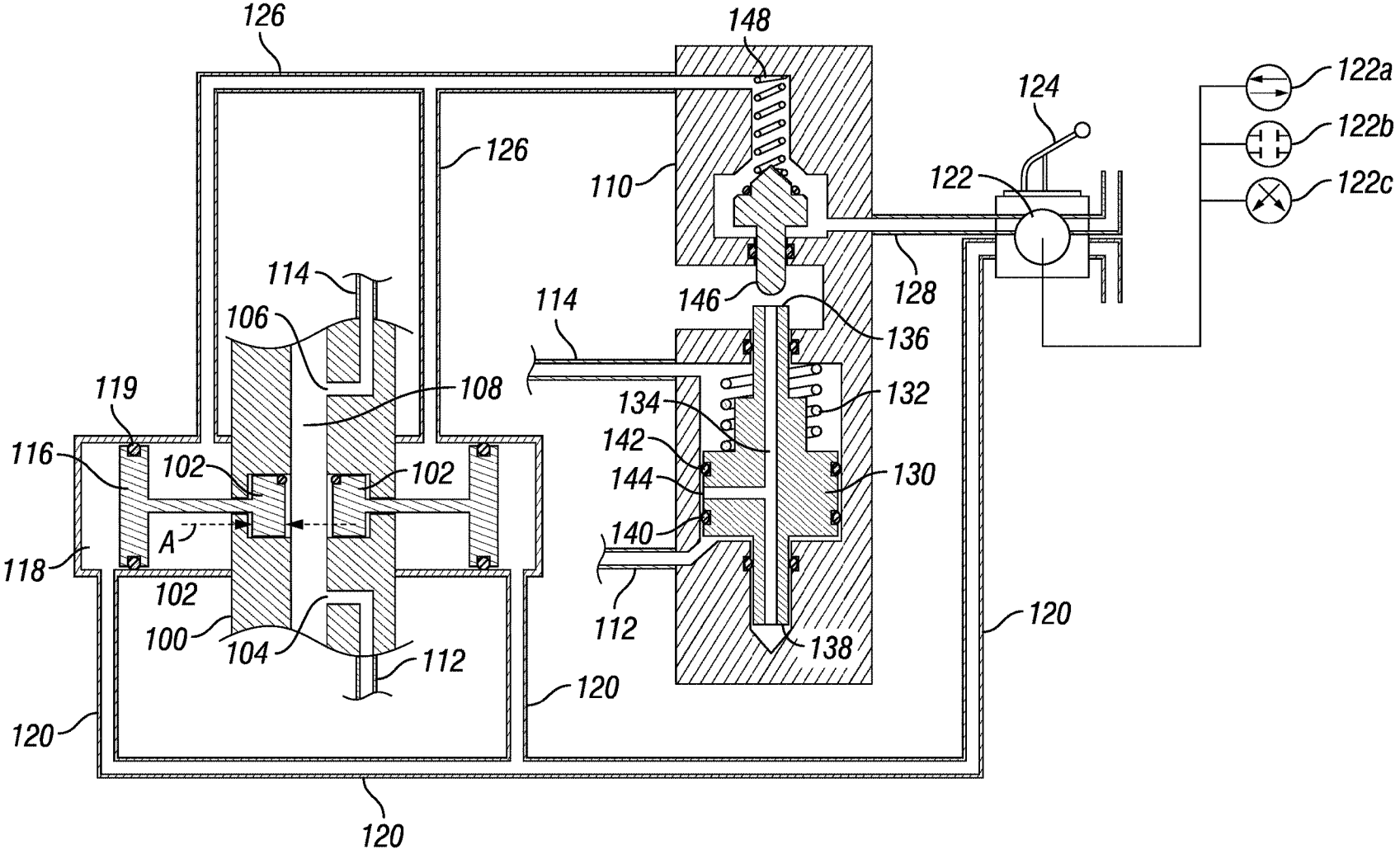
FIG. 1 illustrates an embodiment of a blow out preventer in an open position, in accordance with the disclosure.

Referring now to FIG. 1, in an embodiment of the disclosure, a sealing ram 102 (two shown) such as, but not limited to, a pipe ram or a pipe/slip ram is located in a BOP body 100. A bottom or lower pressure tap 104 and a top or upper pressure tap 106 provide fluid communication between a cavity 108 defined by the BOP body 100 and a control valve 110 by fluid lines or conduits 112 and 114, respectively. The cavity 108 is in fluid communication with the wellbore. Opposed pistons 116 (two shown) are disposed in hydraulic cylinders 118 (two shown) that act through seals 120 (four shown) to push the sealing rams 102 closed (toward the center of cavity 108), or to pull the rams 102 open (away from the inside of the wellbore). In some aspects, each of the sealing rams 102 has a dimension 'A' that is at least half of the diameter of cavity 108 in fluid communication with the wellbore. Sealing rams 102 are designed and constructed in such way that when in a closed position, the portion of cavity 108 in communication with wellbore below sealing rams 102 is securely isolated from the portion of the cavity 108 above sealing rams 102.

A hydraulic line or conduit 120 acts to provide hydraulic pressure to close the sealing rams 102 and is not provided with any auxiliary valve between a BOP selector valve 122 (having a lever 124 which selects from an open position 122*a*, a neutral position 122*b*, and a closed position 122*c*, which is discussed in more detail below) and the cylinders 118. A hydraulic line or conduit 126 acts to provide hydraulic pressure to the sealing rams 102 when in open position.

The control valve 110 is fluidly positioned between the BOP cylinders 118 and the BOP control hydraulic line 128, which also fluidly connects with BOP selector valve 122. When the sealing rams 102 are in open positions, the fluid pressure at pressure tap 104 and top or upper pressure tap 106 are substantially equal, and cavity 108 is fully open in the region proximate sealing rams 102. Also, when the sealing rams 102 are open, a piston 130 housed with a cavity of control valve 110 is held in a closed position by spring 132. A hole 134 bored through piston 130 equalizes pressure at the atmospheric end 136 of piston 130 and the closed end 138 of piston 130. There is also shown venting between a bottom or lower pressure seal 140 disposed on the periphery of piston 130, and a top or upper pressure seal 142 also disposed on the periphery of piston 130, the venting enabled via a hole or passageway 144. A poppet 146 is pushed down by spring 148, leaving an open passage from the hydraulic control line 128 to the hydraulic lines 126, which lead further to the 'open' side of the BOP cylinders 118.

Now with reference to FIG. 2, when the sealing rams 102 are in a closed position as depicted, the pressure below the sealing rams 102, at pressure tap 104, is higher than the pressure above the sealing rams 102, at pressure tap 106. Also, the pressure below the sealing rams 102 is of a pressure value greater than or equal to a value set by the spring force of spring 132. The bottom fluid pressure in cavity 150, which is in fluid communication with pressure tap 104 via conduit 112, pushes piston 130 up into a second cavity 152. Second cavity 152 contains fluid that is at the top fluid pressure via fluid communication with pressure tap 106 through conduit 114. The end of piston 130 will bear on or engage with the poppet 146 and push it into a closed position against spring 148 with force exceeding the spring constant of spring 148. When poppet 146 is in a closed position as depicted, a seal 154 engages with a sealing surface 156 in the control valve body 110, preventing fluid flow from control line 128 to hydraulic conduits 126. Seals 140 and 142 disposed on the outer periphery of piston 130 engageably form a seal with the wall of cavity 150 to isolate fluid under pressure in cavity 150 from second cavity 152. An additional seal 162 is disposed within control valve body 110 to seal with an end portion of piston 130 to isolate fluid in conduit 114 from the environment. With poppet 146 set in a closed position, pressurized fluid supply may be cut off into conduit 126 and not in fluid communication with BOP control hydraulic line 128, while pressurized fluid is resident in conduit 120 and cylinders 118 thus forcing sealing rams 102 into a closed position. In a closed position, sealing rams 102 isolate a top or upper portion of cavity 108 from a bottom lower portion of cavity 108 in communication with wellbore, which is at a relatively higher pressure.

Referring again to FIG. 2, in other aspects, in a manual operation mode using, for example, lever 124, the BOP sealing rams 102 may be prevented from opening if the BOP selector valve 122 is shifted from the neutral position 122*b* to the open position 122*a* using the lever 124 of the selector valve. However, if valve 122 is instead shifted from neutral 122*b*, or open 122*a*, to closed position 122*c*, hydraulic pressure can push open poppet 146 and allow the BOP sealing rams 102 to close. If the BOP sealing ram 102 is in the open state, as depicted in FIG. 1, then piston 130 will be in the down or open state, and not bearing on poppet 146, which may allow BOP sealing rams 102 to open freely.

In some embodiments, the control valve shown as 110 may include only one moving piston, and it may be advantageously integrated into BOP body 100. The control valve 110 may also be provided with a bypass valve allowing normal ram operation at all times when bypassed.

Figure 2:
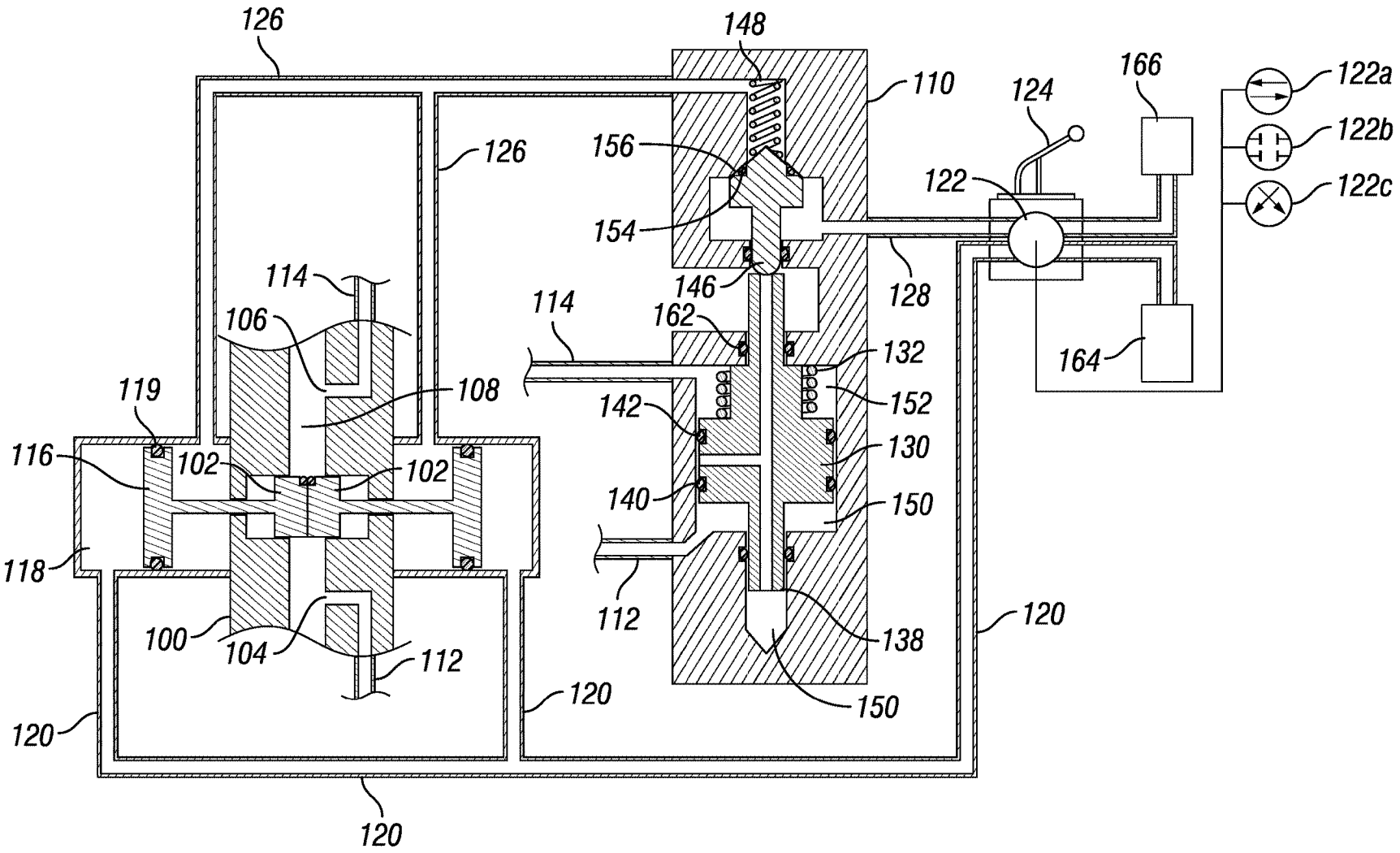
FIG. 2 shows an embodiment of a blow out preventer in a closed position, according to the disclosure.

In some aspects of the embodiment depicted in FIGS. 1 and 2, the apparatus further includes a high pressure fluid supply tank 164 and fluid pressure control tank 166, disposed on an opposing side of valve 122 from control valve 110. Fluid supply tank 164 and fluid pressure control tank 166 may be fluidly connected or separate, depending on the particular arrangement or needs for an operation.

While the embodiment described above depicts specific features, embodiments are not necessarily limited to such. In general, embodiments include apparatus, and methods of use there of, which include a blowout preventer provided with an additional hydraulic valve which senses the differential pressure across a sealing ram(s), and when higher pressure is sensed on the subterranean side of the apparatus, the ram(s) is prevented from opening, and remain in a closed position. In some method embodiments, a blowout preventer body is provided which one or more sealing rams for engaging with a downhole tool, and the sealing ram(s) is hydraulically actuatable between a ram open position and a ram closed position. The sealing ram(s) may be one of a pipe ram, pipe/slip ram, and the like. The blowout preventer further includes an additional hydraulic valve that senses a differential pressure across the sealing ram(s) and operates as a hydraulic interlock to prevent the sealing ram from being moved to the ram open position under predetermined differential pressure conditions. In some aspects, the additional hydraulic valve, such as control valve body 110 depicted in FIGS. 1 and 2, operates as a hydraulic interlock, which prevents the ram(s) from being opened when the valve senses a higher pressure on the bottom, or subterranean formation side, of the blowout preventer than the top of the blowout preventer.

Figure 3:
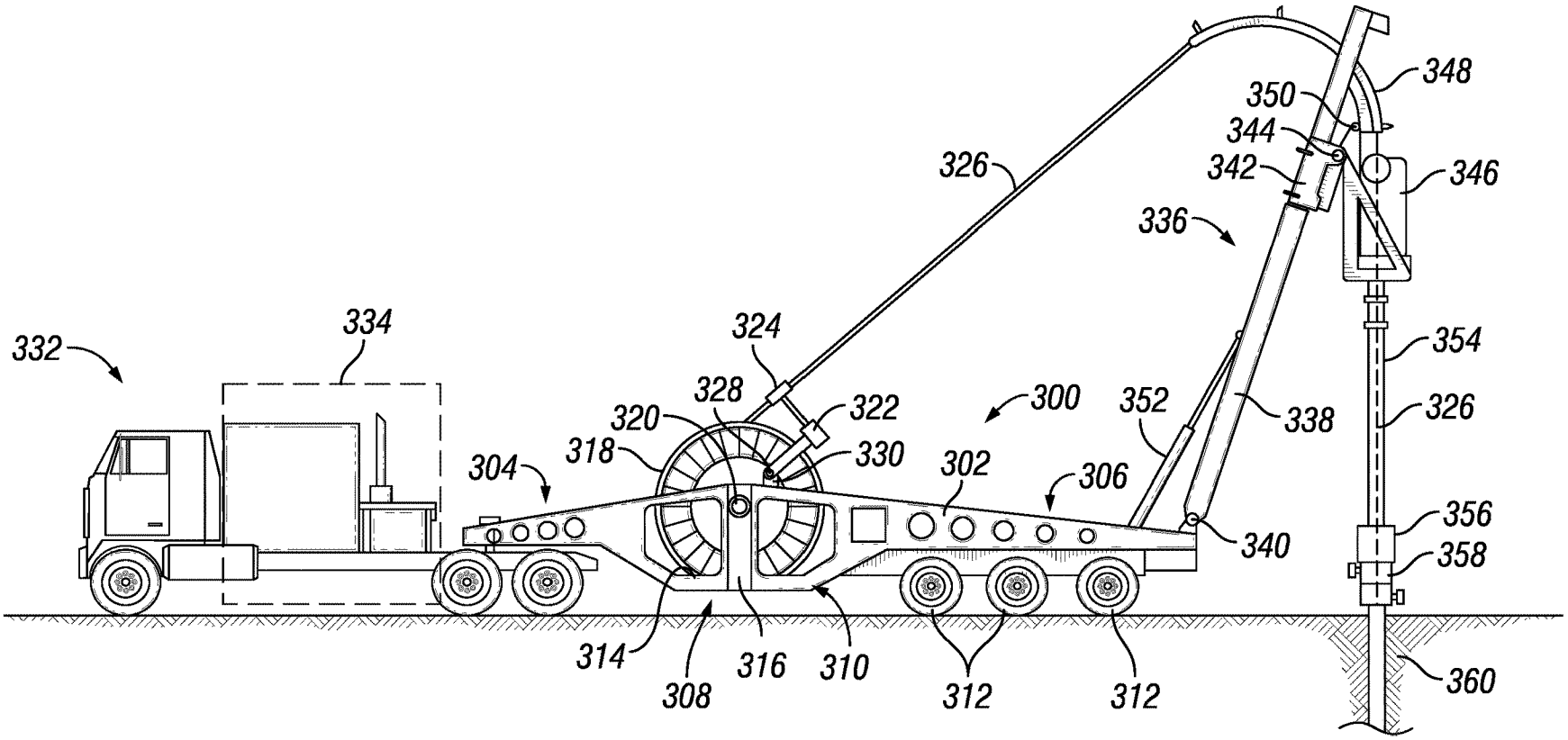
FIG. 3 depicts a coiled tubing apparatus useful with blowout preventers in accordance with an aspect of the disclosure; and, FIGS. 4A-4E illustrate deployment of coiled tubing tools into a wellbore utilizing blowout preventers according to the disclosure.

Some embodiments according to the disclosure involve use of blowout preventers described above for deploying coiled tubing into and out of a wellbore. With reference to FIG. 3, in one such non-limiting embodiment, a coiled tubing trailer 300 is provided which has a pair of side frames 302 extending the length of trailer 300. Trailer 300 includes a front end section 304, a rear end section 306, and a dropped center section 308 between end sections 304 and 306. Dropped center section 310 extends below the upper surface of the trailer wheels as shown at 312 to form a well 314. Vertical struts 316 extend upwardly from well 314. A coiled tubing reel 318 is supported on struts 316 for rotation and is received within the well 314 for projecting a minimal height above a roadway surface. Bearings 320 on struts 316 support reel 318 for rotation. A hydraulic motor may be connected by sprockets and a sprocket chain for rotating reel 318, and a level wind track 322 has a guide 324 to receive coiled tubing 326 for guiding coiled tubing 326 relative reel 318 for reeling and unreeling from reel 318. Track 322 is pivotally mounted at 328 on a support 330. In a stored position, track 26 may be pivoted downwardly. Coiled tubing trailer 300 may be transported by a tractor 332 from one site to another site, and tractor 332 may include suitable power units 334 for powering the coiled tubing unit or rig 300.

A mast generally indicated at 336 includes a pair of parallel posts 338 pivotally mounted at 340 on the rear end of trailer 300 and a trolley or carriage 342 includes a carriage member mounted on each post 338 and having rollers for movement along posts 338. An upper horizontal tubular support 344 is secured between carriage members 342. An injector head 346 has a sleeve mounted on tubular support 344 for pivoting in a vertical plane about tubular support 344. Injector head 346 is movable along tubular support 344 in a horizontal direction to align injector head 346. A gooseneck 348 is mounted on injector head 346 by hinge 350. A pair of hydraulic cylinders 352 is mounted between end section 306 and mast 336, and pivot mast 336 and injector head 346 about pivot 340 between operable and stored positions. A tubular member 354, which may be a riser, extends downwardly from injector head 346 and is adapted for connection to blowout preventer 356, such as blowout preventer depicted in FIGS. 1 and 2, and wellhead 358. Wellhead 358 is connected to a wellbore penetrating a subterranean formation at 360.

In aspects where tubular member 354 is a riser, downhole coiled tubing tools are transferred from atmospheric pressure to wellbore pressure using riser 354, in a coiled tubing deployment process. The coiled tubing deployment may accomplished using a riser 354 which long enough that the entire downhole tool may be placed inside riser 354 at once, and then the riser 354 pressurized after placing the tool therein. If at any point in the deployment process, an unexpected differential pressure is detected across the sealing ram(s), the BOP control valve may close the sealing ram(s) to isolate the higher pressure on the bottom of the blowout preventer 356 from the top of the blowout preventer 356, riser 354, as well as the wellsite. Some non-limiting examples of deployment processes are those disclosed in U.S. Provisional Pat. App. Ser. No. 62/115,791, titled 'Deployment Method For Coiled Tubing', filed Feb. 13, 2015, as well as any related continuity patent applications, each of which is incorporated herein in their entirety by reference thereto. Though shown as a coiled tubing trailer 300, those skilled in the art will appreciate that other types of injectors, masts and the like may be utilized with embodiments of the present disclosure.

Figure 4A:
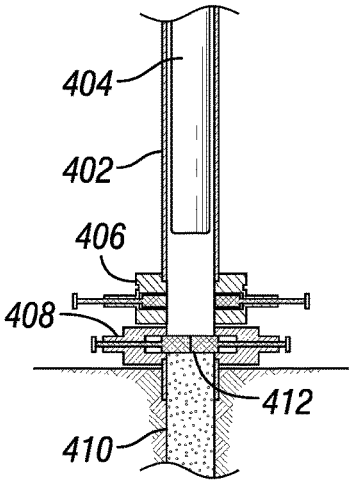

In those instances where longer tools are required, it may not be feasible to deploy the tool in one stage through rise 354 due to limitations on the maximum height for a coiled tubing rig up. In such cases, the downhole tools may be lowered into the wellbore in sections, and hung off of the blowout preventer (BOP) sealing rams using a deployment bar that matches the coiled tubing diameter, as shown in FIGS. 4A-4E. Some non-limiting examples of suitable deployment bars are those disclosed in U.S. Provisional Pat. App. Ser. No. 62/115,750, titled 'Shearable Deployment Bars with Multiple Passages & Cables', filed Feb. 13, 2015, as well as related continuity patent applications, each of which is incorporated herein in their entirety by reference thereto. These deployment bar sections are placed in a riser and may be conveyed in by coiled tubing, wireline, slickline, and the like. In FIG. 4A, an assembly including a riser 402 and tool 404 disposed therein, is placed over blowout preventer 406 and wellhead 408, such as blowout preventer 356 and well head 358 illustrated in FIG. 3, which are situated over high pressure wellbore 410. High pressure wellbore 410 is sealed off by master valve 412, and then riser 402 connected to blowout preventer 406. At any point in this step or steps of the procedure described, if an unexpected differential pressure is detected across the sealing ram(s) 414 (two shown) resident in blowout preventer 406, a BOP control valve (such as 110 shown in FIGS. 1 and 2) in fluid communication with sealing ram(s) 414 may close the sealing ram(s) 414 to isolate the higher pressure on the bottom of the blowout preventer 406 from the top of the blowout preventer 406.

Figure 4B:
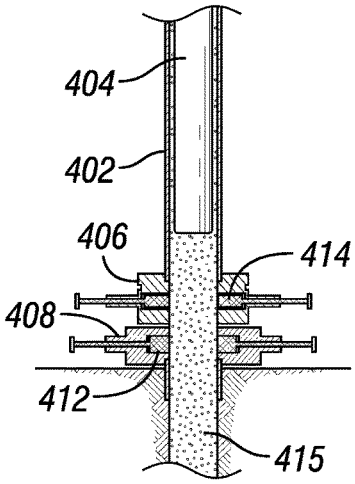
Figure 4C:
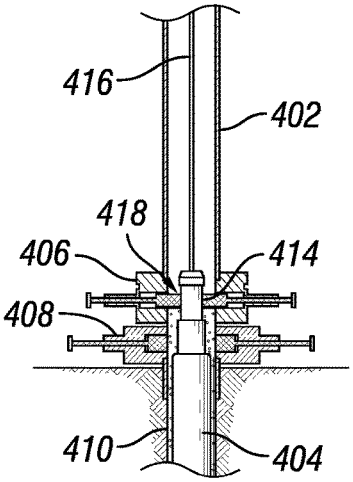
Figure 4D:
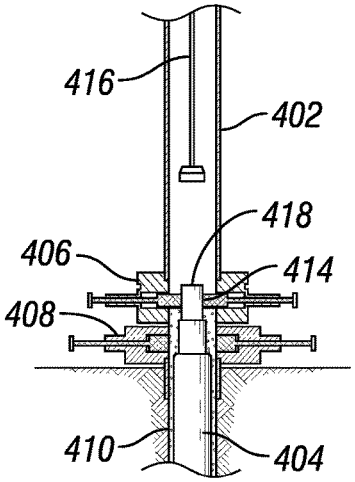

As shown in FIG. 4B, the wellhead or master valve 412 can then be opened thereby pressurizing the whole system to borehole pressure 415. As depicted in FIG. 4C, tool 404, otherwise referred to as a bottom hole assembly, may be passed through blowout preventer 406 and wellhead 408 and into high pressure wellbore 410 by conveyance 416, which may be one of coiled tubing, wireline, slickline and the like. In some aspects, a position sensor can be used to ensure accurate placement of the tool 404. The sealing ram(s) 414 may then be closed on the deployment bar 418 isolating well pressure below blowout preventer 406. As illustrated in FIG. 4D, the pressure above blowout preventer 406 is released 420, the riser 402 disconnected from the blowout preventer 406, and tool 404 suspended the wellbore 410 by sealing ram(s) 414 and deployment bar 418. Conveyance apparatus 416 may then be moved away from blowout preventer 406. The steps illustrated in FIGS. 4A through 4D may be repeated for one tool 404, or any of a plurality of tool 404 sections, required to be deployed into wellbore 410.

Figure 4E:
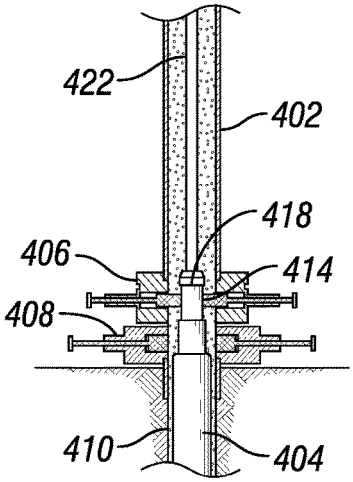

With reference to FIG. 4E, if not already connected, coiled tubing 422 may then be connected with tool 404, or string of tools 404, at deployment bar 418. Riser 402 is secured to blowout preventer 406 and sealing rams 414 then be opened pressurizing the whole system to borehole pressure 415. Tool 404, or string of tools 404, may be conveyed through wellbore 410 by coiled tubing 422, and target operations conducted in the subterranean formation penetrated by wellbore 410.

While some embodiments described above depict coiled tubing operations conducted using a land based rig, embodiments according to the disclosure may also be useful for coiled tubing deployment on an offshore platform or installation, including floating platforms, fixed leg, tension leg, and the like.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. In the figures illustrated, the orientation of particular components is not limiting, and are presented and configured for an understanding of some embodiments of the disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method comprising:

providing a blowout preventer body comprising at least one sealing ram for engaging with a downhole tool, the sealing ram hydraulically actuatable between a ram open position and a ram closed position;

providing a hydraulic control valve for sensing a differential pressure across the at least one sealing ram, wherein the hydraulic control valve is fluidly connected to a cavity in the blowout preventer body, wherein the hydraulic control valve operates as a hydraulic interlock to prevent the at least one sealing ram from being moved to the ram open position under predetermined differential pressure conditions, and wherein the hydraulic control valve is in fluid communication with a selector valve;

connecting the blowout preventer to a wellhead disposed on a wellbore; and deploying the downhole tool and a coiled tubing into and out of the wellbore.

2. The method of claim 1 wherein the at least one sealing ram comprises a pipe ram.

3. The method of claim 1 wherein the at least one sealing ram comprises a pipe/slip ram.

4. The method of claim 1 wherein the hydraulic control valve comprises a poppet and control piston arrangement adjacently disposed within the hydraulic control valve.

5. The method of claim 4 wherein the at least one sealing ram is contained within a cylinder formed in the blowout preventer body, and wherein each of the at least one sealing rams is connected with a ram piston sealingly disposed in the cylinder.

6. The method of claim 5 wherein the ram piston and the cylinder define a first and a second fluid chamber, and wherein the first fluid chamber is in fluid communication with the poppet and the second fluid chamber is in fluid communication with the selector valve.

7. The method of claim 1 wherein the hydraulic control valve is fluidly connected to a pressure tap above the sealing ram and a pressure tap below the sealing ram.

8. The method of claim 1 wherein the selector valve provides open, neutral and closed positions for regulating hydraulic fluid flow.

9. The method of claim 1 wherein the hydraulic control valve operates as a hydraulic interlock when pressure on the subterranean formation side of the blowout preventer body is higher than pressure on the top side of the blowout preventer.

10. The method of claim 1 wherein the downhole tool comprises a deployment bar.

11. The method of claim 1 wherein a plurality of downhole tools is provided, and wherein each downhole tool comprises a deployment bar for engaging with the at least one sealing ram.

12. A method of deploying coiled tubing into and out of a wellbore, comprising:

providing a blowout preventer body comprising at least one sealing ram for engaging with a downhole tool, wherein the at least one sealing ram is contained within a cylinder formed in the blowout preventer body, and wherein each of the at least one sealing rams is connected with a ram piston sealingly disposed in the cylinder;

providing a hydraulic control valve comprising a poppet and control piston arrangement adjacently disposed therein, wherein the hydraulic control valve is fluidly connected with the blowout preventer body, and wherein the hydraulic control valve is in fluid communication with a selector valve;

connecting the blowout preventer to a wellhead disposed on a wellbore; and deploying the downhole tool and the coiled tubing into and out of the wellbore.

13. The method of claim 12 wherein the downhole tool comprises a deployment bar.

14. The method of claim 12 wherein a plurality of downhole tools is provided, and wherein each downhole tool comprises a deployment bar for engaging with the at least one sealing ram.

15. The method of claim 12 wherein the ram piston and the cylinder define a first and a second fluid chamber, and wherein the first fluid chamber is in fluid communication with the poppet and the second fluid chamber is in fluid communication with the selector valve.

16. The method of claim 12 wherein the hydraulic control valve operates as a hydraulic interlock when pressure on the subterranean formation side of the blowout preventer body is higher than pressure on the top side of the blowout preventer.

17. The method of claim 12 wherein the selector valve provides open, neutral and closed positions for regulating hydraulic fluid flow.

18. A system comprising:

a blowout preventer body comprising at least one sealing ram for engaging with a downhole tool, the sealing ram hydraulically actuatable between a ram open position and a ram closed position;

a hydraulic control valve comprising a poppet and control piston arrangement adjacently disposed therein, wherein the hydraulic control valve is fluidly connected with the blowout preventer body, and wherein the hydraulic control valve is in fluid communication with a selector valve;

a wellhead disposed on a wellbore upon which the blowout preventer is sealingly connected;

a downhole tool and a coiled tubing deployed through the blowout preventer body, the wellhead and the wellbore.

19. The system of claim 18 wherein the at least one sealing ram is contained within a cylinder formed in the blowout preventer body, and wherein each of the at least one sealing rams is connected with a ram piston sealingly disposed in the cylinder.

20. The system of claim 19 wherein the ram piston and the cylinder define a first and a second fluid chamber, and wherein the first fluid chamber is in fluid communication with the poppet and the second fluid chamber is in fluid communication with the selector valve.

21. The system of claim 18 wherein the hydraulic control valve operates as a hydraulic interlock when pressure on the subterranean formation side of the blowout preventer body is higher than pressure on the top side of the blowout preventer.

22. The system of claim 18 wherein the selector valve provides open, neutral and closed positions for regulating hydraulic fluid flow.

* * * * *